US011089914B2

(12) United States Patent
Wu et al.

(10) Patent No.: US 11,089,914 B2
(45) Date of Patent: Aug. 17, 2021

(54) LIQUID PUMP MECHANISM FOR SOAP DISPENSER

(71) Applicant: Purity (Xiamen) Sanitary Ware Co., Ltd., Xiamen (CN)

(72) Inventors: James Wu, Taichung (TW); Alex Wu, Taichung (TW); Ce-Wen Yang, Xiamen (CN); Gao-Shan Lin, Xiamen (CN); Shi-Fa Huang, Xiamen (CN); Guo-Zhong Wu, Xiamen (CN)

(73) Assignee: PURITY (XIAMEN) SANITARY WARE CO., LTD., Xiamen (CN)

( * ) Notice: Subject to any disclaimer, the term of this patent is extended or adjusted under 35 U.S.C. 154(b) by 0 days.

(21) Appl. No.: 16/919,406

(22) Filed: Jul. 2, 2020

(65) Prior Publication Data

US 2021/0000304 A1 Jan. 7, 2021

(30) Foreign Application Priority Data

Jul. 5, 2019 (CN) ..... 201910603415.0

(51) Int. Cl.
*A47K 5/12* (2006.01)

(52) U.S. Cl.
CPC ..... *A47K 5/1211* (2013.01)

(58) Field of Classification Search
CPC ..... A47K 5/1211; A47K 5/1204
See application file for complete search history.

(56) References Cited

U.S. PATENT DOCUMENTS 4,349,134 A * 9/1982 Schuster ..... B65D 47/2081 222/212
4,506,809 A * 3/1985 Corsette ..... B65D 47/2081 222/213
5,692,651 A * 12/1997 Fuchs ..... B65D 47/2081 222/494
2015/0008243 A1* 1/2015 Chen ..... B05B 7/005 222/190

FOREIGN PATENT DOCUMENTS

CN 205006764 U * 2/2016
CN 206120182 U 4/2017

* cited by examiner

*Primary Examiner* — Donnell A Long
(74) *Attorney, Agent, or Firm* — Birch, Stewart, Kolasch & Birch LLP

(57) ABSTRACT

A liquid pump mechanism for a soap dispenser includes a pump body, and an outlet tube, an upper wave-shaped pad, a piston, a spring, an annular internal sleeve, and a lower wave-shaped pad which are sequentially disposed inside the pump body from top down. A dividing member formed in the pump body divides an inner cavity of the pump body into a main chamber and an inlet chamber. An outlet passage is formed in the outlet tube. The outlet tube and the main chamber are movably sealed and engaged. The piston divides the main chamber into a compatible chamber and a liquid soap chamber. An outlet hole communicating the outlet passage and the liquid soap chamber is disposed on the piston. An inlet hole communicating the liquid soap chamber and the inlet chamber is disposed on the dividing member. The upper wave-shaped pad is disposed between the outlet tube and the piston and movably closes the outlet hole. The lower wave-shaped pad is disposed between the annular internal sleeve and the dividing member and movably closes the inlet hole.

5 Claims, 3 Drawing Sheets

LIQUID PUMP MECHANISM FOR SOAP DISPENSER

BACKGROUND OF THE INVENTION

Technical Field

The present invention relates generally to a soap dispenser, and more particularly to a liquid pump mechanism for a soap dispenser.

Description of Related Art

Soap dispensers are common washing utensils in kitchens or bathrooms, which are usually installed next to the faucet of the sink. Typically, a conventional soap dispenser includes a housing, a soap bottle, and a liquid pump, wherein a pressed head and a liquid outlet are formed on the housing. When the pressed head is pressed, an internal assembly will be driven by the pressed head to output liquid soap received in an inside of the liquid pump via the liquid outlet. After the pressed head is released, the internal assembly operates to absorb the liquid soap received in the soap bottle to the inside of the liquid pump.

The liquid pump of the conventional soap dispenser generally adopts a duckbill-type unidirectional valve structure or a ball-type unidirectional valve structure to absorb and output the liquid soap. For example, Chinese patent CN205006764U discloses a soap dispenser adopting a duckbill-type unidirectional valve structure; Chinese patent CN206120182U discloses a soap dispenser adopting a ball-type unidirectional valve structure. However, it is difficult to process the duckbill-type unidirectional valve structure. In addition, the size of an opening of the duckbill-type unidirectional valve structure has poor stability, so that the sealing effect of the duckbill-type unidirectional valve structure is relatively poor, which seriously affects the stability of the dispensed quantity of the liquid pump. Moreover, a service life of the duckbill-type unidirectional valve structure is also poor. The ball-type unidirectional valve structure requires high dimensional accuracy of the ball. If the ball size error is too large, leakage problems of the liquid soap will occur.

BRIEF SUMMARY OF THE INVENTION

In view of the above, the primary objective of the present invention is to provide a liquid pump mechanism for a soap dispenser, which could provide a better stability and reliability.

The present invention provides a liquid pump mechanism for a soap dispenser, including an outlet tube, an upper wave-shaped pad, a piston, a spring, an annular internal sleeve, a lower wave-shaped pad, and a pump body, wherein pump body has a top opening and a bottom opening. A dividing member is formed inside the pump body and divides an inner cavity of the pump body into a main chamber and an inlet chamber. The outlet tube, the upper wave-shaped pad, the piston, the spring, the annular internal sleeve, and the lower wave-shaped pad are sequentially disposed inside the main chamber from top down along an axial direction of the pump body, wherein the outlet tube, the upper wave-shaped pad, and the piston are movable in the main chamber along the axial direction of the pump body. An outlet passage is formed in the outlet tube. The outlet tube is movably sealed the main chamber. The piston divides the main chamber into a compatible chamber and a liquid soap chamber. At least one outlet hole, which communicates the outlet passage and the liquid soap chamber, is disposed on the piston. At least one inlet hole, which communicates the liquid soap chamber and the inlet chamber, is disposed on the dividing member. The upper wave-shaped pad is an annular structure having a through hole, wherein a peripheral edge of the upper wave-shaped pad is disposed between the outlet tube and the piston. The upper wave-shaped pad movably closes the outlet hole. Two ends of the spring respectively abut against the piston and the annular internal sleeve. The lower wave-shaped pad is an annular structure having a through hole, wherein a peripheral edge of the lower wave-shaped pad is disposed between the annular internal sleeve and the dividing member. The lower wave-shaped pad movably closes the inlet hole.

In an embodiment, a piston protrusion is formed on and protrudes upward from a center of the piston; the through hole of the upper wave-shaped pad movably fits around the piston protrusion; a protrusion is formed on and protrudes upward from a center of the dividing member; the through hole of the lower wave-shaped pad movably fits around the protrusion.

In an embodiment, the liquid pump mechanism further includes a mount connector disposed on the top opening of the pump body, wherein a mounting hole, which movably fits around the outlet tube, is disposed on the mount connector; a restriction flange is formed on and protrudes from an outer wall of the outlet tube in a radial direction of the outlet tube; a blocking edge, which movably abuts against a top surface of the restriction flange, is disposed on an inner wall of the mounting hole.

In an embodiment, the mount connector passes through the top opening of the pump body; a snap-fit connector is disposed on an outer wall of the mount connector; a through hole, which is adapted to be engaged by the snap-fit connector, is disposed on a sidewall of the pump body.

In an embodiment, a sealing ring is disposed between an outer wall of the outlet tube and an inner wall of the main chamber.

In an embodiment, an annular groove is disposed on the outlet tube and is adapted to be fitted by the sealing ring.

With the aforementioned design, the outlet hole could be opened or closed by the upper wave-shaped pad, thereby to realize a unidirectional communication between the outlet passage and the liquid soap chamber. The inlet hole could be opened or closed by the lower wave-shaped pad, thereby to realize a unidirectional communication between the liquid soap chamber and the inlet chamber. In addition, sizes of the upper wave-shaped pad and the lower wave-shaped pad are easily controlled during manufacturing, which ensures that the upper wave-shaped pad and the lower wave-shaped pad could stably close the outlet hole and the inlet hole, so that a dispensed quantity of the liquid soap that the liquid soap chamber delivers to the outlet passage each time could be stable, providing a better stability and reliability.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
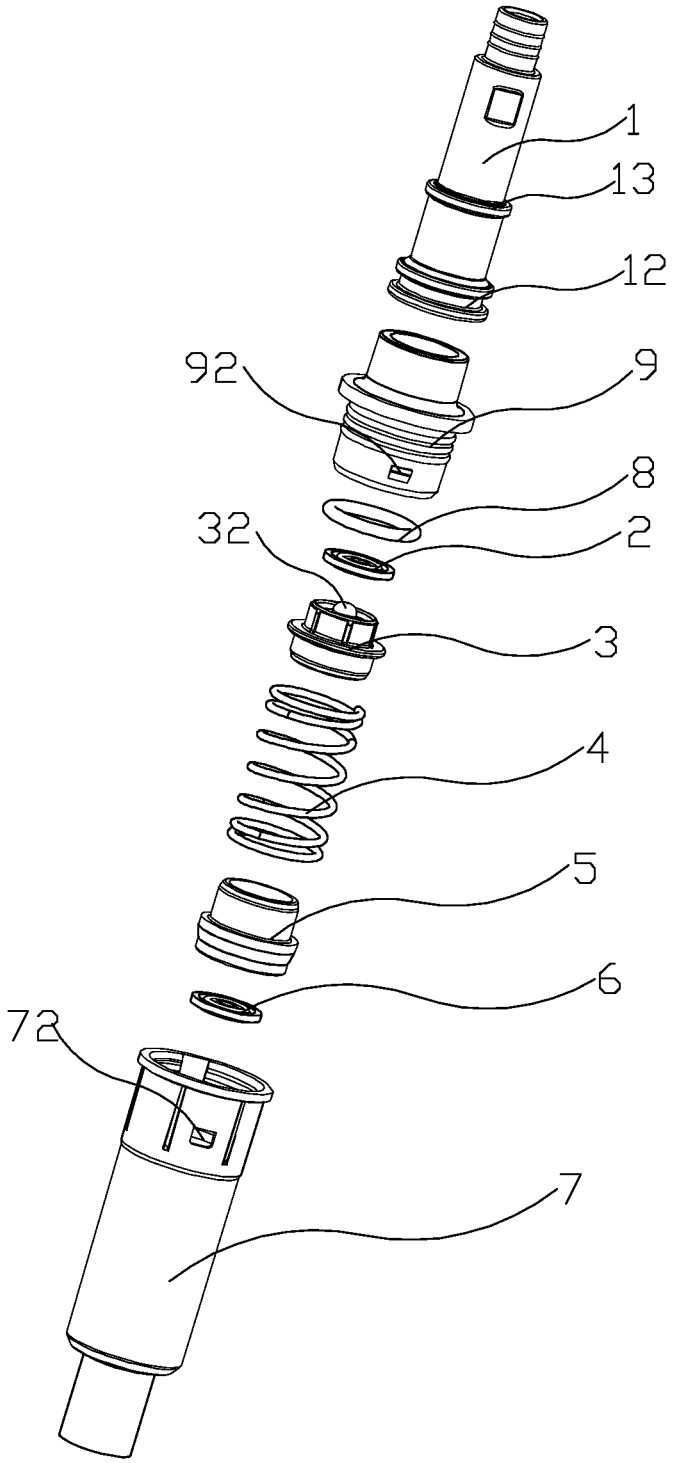
FIG. 1 is an exploded view of the liquid pump mechanism for the soap dispenser according to an embodiment of the present invention.
Figure 2:
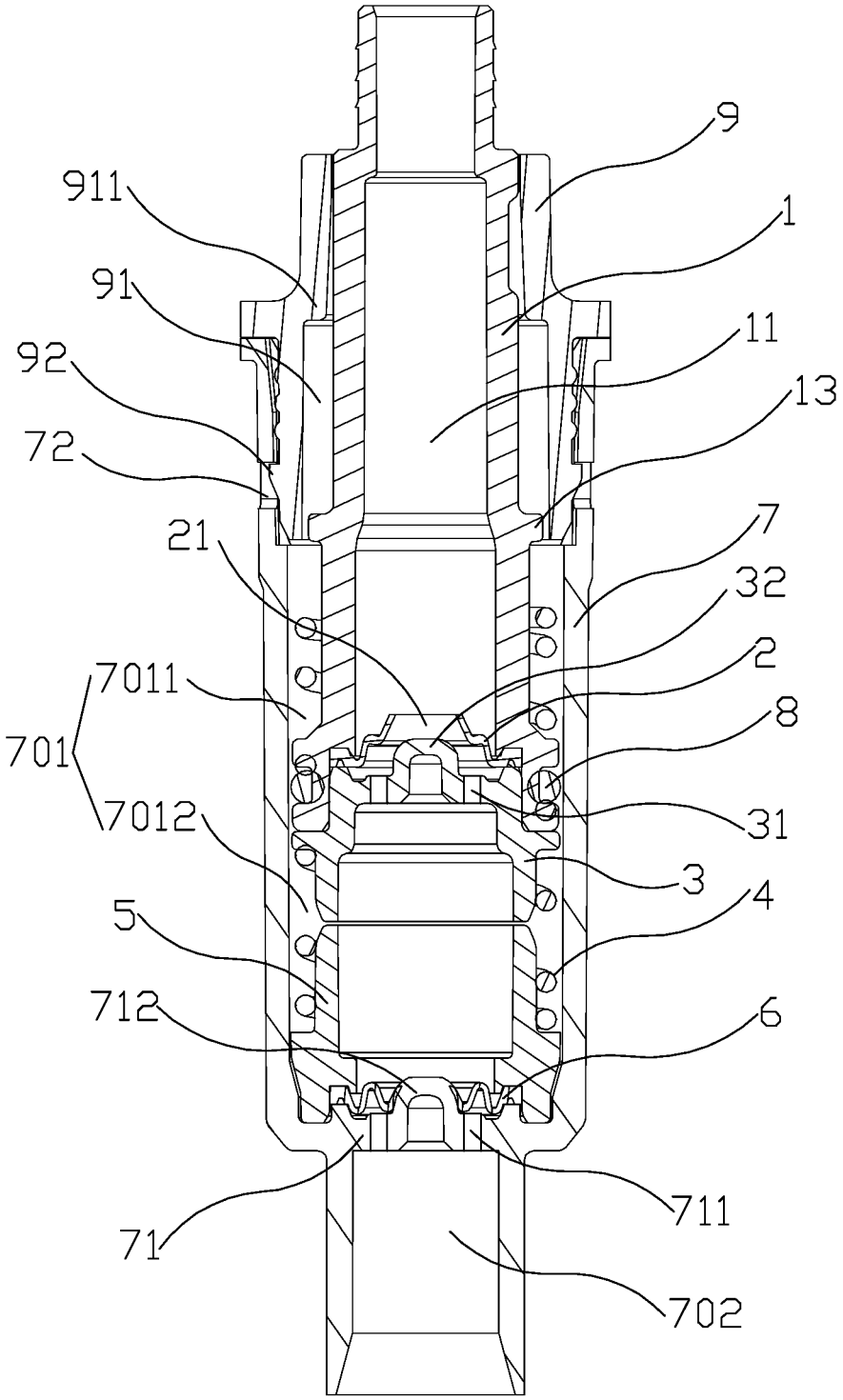
FIG. 2 is a sectional view showing the outlet tube of the liquid pump mechanism according to the embodiment of the present invention is pressed.
Figure 3:
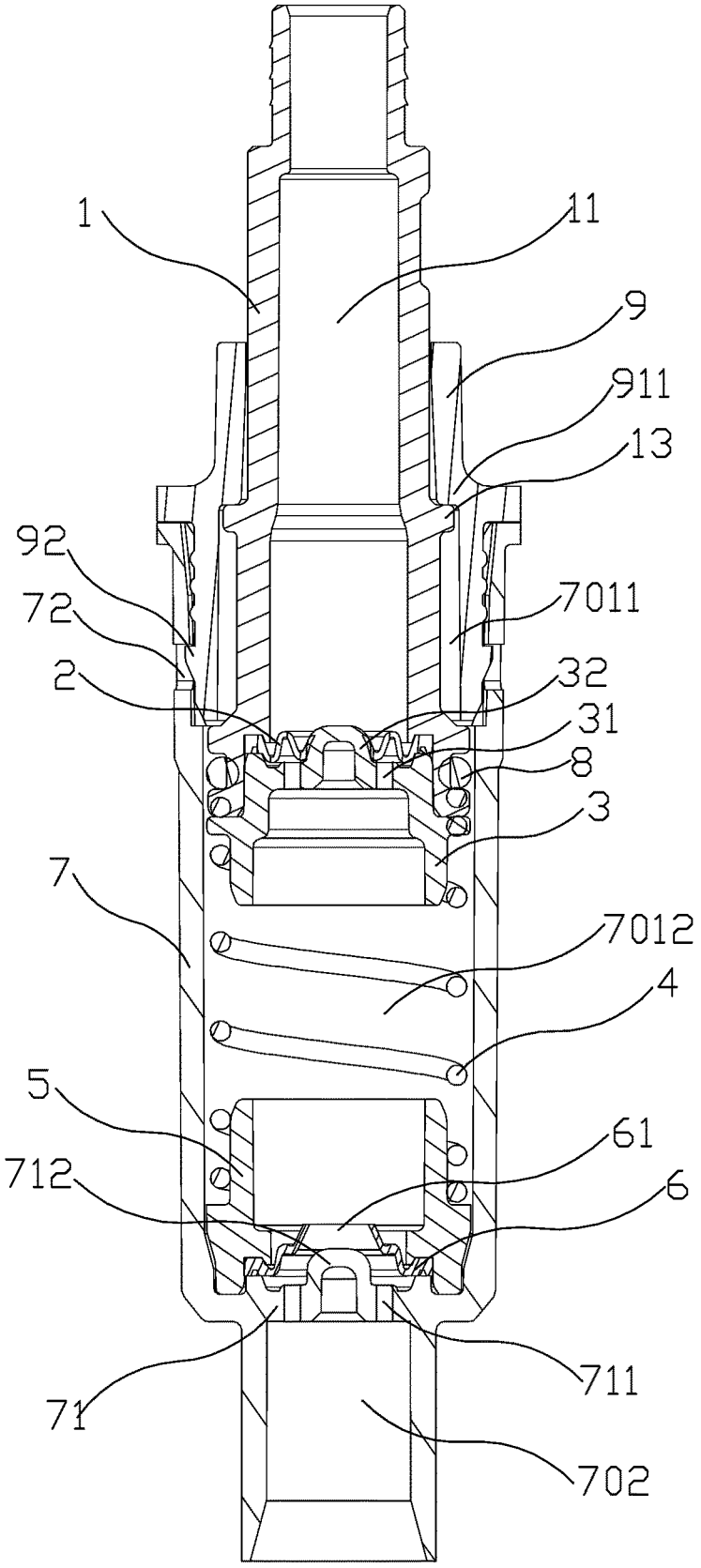
FIG. 3 is a sectional view showing the outlet tube of the liquid pump mechanism according to the embodiment of the present invention is released.

A liquid pump mechanism for a soap dispenser according to an embodiment of the present invention is illustrated in FIG. 1 to FIG. 3, wherein the liquid pump mechanism includes an outlet tube 1, an upper wave-shaped pad 2, a piston 3, a spring 4, an annular internal sleeve 5, a lower wave-shaped pad 6, and a pump body 7.

Referring to FIG. 1 to FIG. 3, the pump body 7 has a top opening and a bottom opening in an axial direction of the pump body 7, wherein a dividing member 71 is formed inside the pump body 7. The dividing member 71 divides an inner cavity of the pump body 7 into a main chamber 701 and an inlet chamber 702, wherein the inlet chamber 702 is adapted to communicate with a liquid soap bottle. At least one inlet hole 711, which communicates the main chamber 701 and the inlet chamber 702, is disposed on the dividing member 71.

Referring to FIG. 1 to FIG. 3, the outlet tube 1, the upper wave-shaped pad 2, the piston 3, the spring 4, the annular internal sleeve 5, and the lower wave-shaped pad 6 are sequentially disposed inside the main chamber 701 from top down, wherein the outlet tube 1, the upper wave-shaped pad 2, and the piston 3 are movable in the main chamber 701 along the axial direction of the pump body 7.

Referring to FIG. 2 and FIG. 3, an outlet passage 11 is formed in the outlet tube 1, wherein a sealing ring 8 is disposed between an outer wall of the outlet tube 1 and an inner wall of the main chamber 701, so that the outlet tube 1 is engaged with the main chamber 701 in a movably sealed way (i.e., the outlet tube 1 and the main chamber 701 are movably sealed and engaged), thereby to prevent a liquid soap from leaking from a joint between the outer wall of the outlet tube 1 and the inner wall of the main chamber 701. The piston 3 divides the main chamber 701 into a compatible chamber 7011 and a liquid soap chamber 7012, wherein at least one outlet hole 31, which communicates the outlet passage 11 and the liquid soap chamber 7012, is disposed on the piston 3. The inlet hole 711 communicates the liquid soap chamber 7012 and the inlet chamber 702. The upper wave-shaped pad 2 is an annular structure with a through hole 21, wherein a peripheral edge of the upper wave-shaped pad 2 is disposed between the outlet tube 1 and the piston 3. The upper wave-shaped pad 2 movably closes the outlet hole 31, thereby to control the communication between the outlet passage 11 and the liquid soap chamber 7012. Two ends of the spring 4 respectively abut against the piston 3 and the annular internal sleeve 5, thereby to urge the piston 3 and the outlet tube 11 to restore. The lower wave-shaped pad 6 is an annular structure with a through hole 61, wherein a peripheral edge of the lower wave-shaped pad 6 is disposed between the annular internal sleeve 5 and the dividing member 71. The lower wave-shaped pad 2 movably closes the inlet hole 711, thereby to control the communication between the liquid soap chamber 7012 and the inlet chamber 702.

Referring to FIG. 2 and FIG. 3, a piston protrusion 32 is formed on and protrudes upward from a center of the piston 3, wherein the through hole 21 of the upper wave-shaped pad 2 movably fits around the piston protrusion 32. A protrusion 712 is formed on and protrudes upward from a center of the dividing member 71, wherein the through hole 61 of the lower wave-shaped pad 6 movably fits around the protrusion 712. In this way, during a process of assembling, the through hole 21 of the upper wave-shaped pad 2 fits around the piston protrusion 32 to position the upper wave-shaped pad 2, and the through hole 61 of the lower wave-shaped pad 6 fits around the protrusion 712 to position the lower wave-shaped pad 6, thereby to prevent the upper wave-shaped pad 2 and the lower wave-shaped pad 6 shift during installation.

Referring to FIG. 1 to FIG. 3, the liquid pump mechanism of the present invention could further include a mount connector 9 disposed on the top opening of the pump body 7, wherein a mounting hole 91, which movably fits around the outlet tube 1, is disposed on the mount connector 9. A restriction flange 13 is formed on and protrudes from an outer wall of the outlet tube 1 in a radial direction of the outlet tube 1, wherein the restriction flange 13 is located above an annular groove 12 of the outlet tube 1. The is adapted to be fitted by the sealing ring 8, an annular groove A blocking edge 911, which movably abuts against a top surface of the restriction flange 13, is disposed on an inner wall of the mounting hole 91. In this way, with the compatibility between the blocking edge 911 and the restriction flange 13, the outlet tube 1, the upper wave-shaped pad 2, the piston 3, the spring 4, the annular internal sleeve 5, and the lower wave-shaped pad 6 could be prevented from disengaging from the top opening of the pump body 1, wherein the mount connector 9 passes through the top opening of the pump body 7. A snap-fit connector 92 is disposed on an outer wall of the mount connector 9, and a through hole 72, which is adapted to be engaged by the snap-fit connector 92, is disposed on a sidewall of the pump body 7, so that the mount connector 9 is snapped engaged with the pump body 7.

Referring to FIG. 2 and FIG. 3, the principle of the liquid pump mechanism of the present invention will be described in detail as follow.

When the outlet tube 1 is pressed to push the piston 3 to move downward, the spring 4 is compressed; at this time, a space of the liquid soap chamber 7012 becomes smaller, which increases a pressure inside the liquid soap chamber 7012. At this time, the lower wave-shaped pad 6 deforms downward with the pressure inside the liquid soap chamber 7012 to close the inlet hole 711. At the same time, the upper wave-shaped pad 2 deforms upward with the pressure inside the liquid soap chamber 7012 to form a gap between the piston 3 and the upper wave-shaped pad 2 to open the outlet hole 31, so that the liquid soap received in the liquid soap chamber 7012 could enter the outlet passage 11 via the outlet hole 31 and flow out of the outlet passage 11.

After the outlet tube 1 is released, the spring 4 urges the piston 3 and the outlet tube 1 to move upward to restore; at this time, the space of the liquid soap chamber 7012 becomes larger to generate a negative pressure, so that the upper wave-shaped pad 2 deforms downward to close the outlet hole 31, and the lower wave-shaped pad 6 deforms upward to open the inlet hole 711. At this time, the liquid soap received in the inlet chamber 11 could enter the liquid soap chamber 7012 via the inlet hole 711, thereby to replenish the liquid soap chamber 7012 with the liquid soap.

With the aforementioned design, the outlet hole 31 could be opened or closed by the upper wave-shaped pad 2, thereby to realize a unidirectional communication between the outlet passage 11 and the liquid soap chamber 7012; the inlet hole 711 could be opened or closed by the lower wave-shaped pad 6, thereby to realize a unidirectional communication between the liquid soap chamber 7012 and the inlet chamber 702. In addition, sizes of the upper wave-shaped pad 2 and the lower wave-shaped pad 6 are easily controlled during manufacturing, which ensures that the upper wave-shaped pad 2 and the lower wave-shaped pad 6 could stably close the outlet hole 31 and the inlet hole 711, so that a dispensed quantity of the liquid soap that the liquid soap chamber 7012 deliver to the outlet passage 11 each time could be stable, providing a better stability and reliability.

It must be pointed out that the embodiments described above are only some preferred embodiments of the present invention. All equivalent structures which employ the concepts disclosed in this specification and the appended claims should fall within the scope of the present invention.

What is claimed is:

1. A liquid pump mechanism for a soap dispenser, which is characterized in that:

the liquid pump mechanism comprises an outlet tube, an upper wave-shaped pad, a piston, a spring, an annular internal sleeve, a lower wave-shaped pad, and a pump body;

the pump body has a top opening and a bottom opening, wherein a dividing member is formed inside the pump body and divides an inner cavity of the pump body into a main chamber and an inlet chamber;

the outlet tube, the upper wave-shaped pad, the piston, the spring, the annular internal sleeve, and the lower wave-shaped pad are sequentially disposed inside the main chamber from top down along an axial direction of the pump body, wherein the outlet tube, the upper wave-shaped pad, and the piston is movable in the main chamber along the axial direction of the pump body;

an outlet passage is formed in the outlet tube; the outlet tube is movably sealed the main chamber; the piston divides the main chamber into a compatible chamber and a liquid soap chamber; at least one outlet hole, which communicates the outlet passage and the liquid soap chamber, is disposed on the piston; at least one inlet hole, which communicates the liquid soap chamber and the inlet chamber, is disposed on the dividing member; the upper wave-shaped pad is an annular structure having a through hole, wherein a peripheral edge of the upper wave-shaped pad is disposed between the outlet tube and the piston; the upper wave-shaped pad movably closes the outlet hole; two ends of the spring respectively abut against the piston and the annular internal sleeve; the lower wave-shaped pad is an annular structure having a through hole, wherein a peripheral edge of the lower wave-shaped pad is disposed between the annular internal sleeve and the dividing member; the lower wave-shaped pad movably closes the inlet hole;

wherein a piston protrusion is formed on and protrudes upward from a center of the piston; the through hole of the upper wave-shaped pad movably fits around the piston protrusion; a protrusion is formed on and protrudes upward from a center of the dividing member; the through hole of the lower wave-shaped pad movably fits around the protrusion;

when the outlet tube is pressed to push the piston to move downward, the upper wave-shaped pad deforms upward and is not engaged with the piston protrusion, and the lower wave-shaped pad closely fits around the protrusion on the center of the dividing member to close the at least one inlet hole, wherein at this time, the piston protrusion is located lower than an upper opening of the through hole of the upper wave-shaped pad in the axial direction of the pump body; when the outlet tube is released, the upper wave-shaped pad deforms downward to closely fits around the piston protrusion to close the at least one outlet hole, and the lower wave-shaped pad deforms upward and is not engaged with the protrusion on the center of the dividing member, wherein at this time, the protrusion on the center of the dividing member is located lower than an upper opening of the through hole of the lower wave-shaped pad in the axial direction of the pump body, and the main chamber does not communicate with an outside.

2. The liquid pump mechanism as claimed in claim 1, further comprising a mount connector disposed on the top opening of the pump body, wherein a mounting hole, which movably fits around the outlet tube, is disposed on the mount connector; a restriction flange is formed on and protrudes from an outer wall of the outlet tube in a radial direction of the outlet tube; a blocking edge, which movably abuts against a top surface of the restriction flange, is disposed on an inner wall of the mounting hole.

3. The liquid pump mechanism as claimed in claim 2, wherein the mount connector passes through the top opening of the pump body; a snap-fit connector is disposed on an outer wall of the mount connector; a through hole, which is adapted to be engaged by the snap-fit connector, is disposed on a sidewall of the pump body.

4. The liquid pump mechanism as claimed in claim 1, wherein a sealing ring is disposed between an outer wall of the outlet tube and an inner wall of the main chamber.

5. The liquid pump mechanism as claimed in claim 4, wherein an annular groove is disposed on the outlet tube and is adapted to be fitted by the sealing ring.

* * * * *